US005492300A

United States Patent [19]

Riihiluoma et al.

[11] Patent Number: 5,492,300

[45] Date of Patent: Feb. 20, 1996

[54] LEVELING APPARATUS AND METHOD

[75] Inventors: Clayton W. Riihiluoma, Fridley; Sheila K. Dokken, Elk River, both of Minn.

[73] Assignee: D & R Ventures, Inc., Fridley, Minn.

[21] Appl. No.: 301,675

[22] Filed: Sep. 7, 1994

[51] Int. Cl.[6] ..... A47F 5/00

[52] U.S. Cl. ..... 248/354.1; 254/93 HP; 280/6.12

[58] Field of Search ..... 248/354.1, 354.6, 248/352, 188.2; 280/840, 6.1, 6.11, 6.12; 254/93 HP, 93 H, 93 VA

[56] References Cited

U.S. PATENT DOCUMENTS

| | | | |
|---|---|---|---|
| 1,344,037 | 6/1920 | Heymann | 254/93 HP |
| 1,745,959 | 2/1930 | Steiner . | |
| 2,070,960 | 2/1937 | Phillips . | |
| 2,610,824 | 9/1952 | Grier | 254/93 HP |
| 2,804,118 | 8/1957 | Bayerkohler . | |
| 3,174,722 | 3/1965 | Alm . | |
| 3,857,582 | 12/1974 | Hartog | 248/354.1 |
| 4,014,517 | 3/1977 | Keagle | 248/352 X |
| 4,323,141 | 4/1982 | Ragan | 254/93 HP |
| 4,605,203 | 8/1986 | Hooper et al. . | |
| 4,784,400 | 11/1988 | Hofius | 280/6.1 |
| 5,096,160 | 3/1992 | Calico et al. . | |
| 5,143,386 | 9/1992 | Uriarte | 280/6.12 X |
| 5,178,367 | 1/1993 | Vaughen . | |
| 5,188,379 | 2/1993 | Krause | 280/6.12 |
| 5,232,202 | 8/1993 | Watson . | |
| 5,312,119 | 5/1994 | Scheider | 280/6.12 X |

FOREIGN PATENT DOCUMENTS

| | | | |
|---|---|---|---|
| 1251314 | 4/1902 | France | 254/93 HP |

*Primary Examiner*—J. Franklin Foss

*Attorney, Agent, or Firm*—Merchant, Gould, Smith, Edell, Welter & Schmidt

[57] ABSTRACT

A leveling apparatus comprising a frame assembly including a top frame structure and a bottom frame structure, the top and bottom frame structures interconnected by an extensible wall structure; an inflatable bladder assembly, the bladder assembly being substantially enclosed by the top and bottom frame structures and the extensible wall structure, whereby the top frame structure is raised and lowered upon inflation and deflation, respectively, of the bladder assembly; locking means for retaining the frame assembly in a raised, extended position upon deflation of the bladder assembly; and fluid inlet and outlet means in fluid communication with the bladder assembly for inflating and deflating the bladder assembly.

19 Claims, 6 Drawing Sheets

LEVELING APPARATUS AND METHOD

BACKGROUND OF THE INVENTION

The present invention relates to a leveling apparatus and method for leveling structures and in particular for leveling campers or the like.

When a camper is parked, such as a "pop-up" camper, trailer, 5th wheeler, pickup camper, motor home, etc., it is important that the camper be substantially level. Some of the more expensive campers have integral, built in leveling systems included. However, many camper vehicles do not have an integral leveling system. Most people will use blocks of wood or other objects which are placed under one of the wheels of the camper in an effort to level the camper. Many people will carry blocks of wood with them just for this purpose since it is often difficult to find properly sized blocks of wood at the camp site.

This method often requires much trial and error and often does not result in a properly leveled camper.

A more convenient, less expensive apparatus and method is desired for leveling campers.

BRIEF SUMMARY OF THE INVENTION

The present invention relates to a leveling apparatus and method for leveling structures and in particular for leveling campers or the like.

In one embodiment of the present invention, an inflatable bladder assembly having a top and bottom frame structure is used to raise one of the wheels of a camper or the like until the camper is leveled.

In one embodiment of the present invention, the leveling apparatus includes:

- a frame assembly including a top frame structure and a bottom frame structure, the top and bottom frame structures interconnected by a vertically extensible wall structure;
- an inflatable bladder assembly, the bladder assembly being substantially enclosed by the top and bottom frame structures and the extensible wall structure, whereby the top frame structure is raised and lowered upon inflation and deflation, respectively, of the bladder assembly;
- locking means for retaining the frame assembly in a raised, extended position upon deflation of the bladder assembly; and
- fluid inlet/outlet means in fluid communication with the bladder assembly for inflating and deflating the bladder assembly.

In one embodiment of the present invention, the top frame structure has a top surface which has a recessed contour to assist in properly positioning a tire on the top frame structure.

In one embodiment of the present invention, the locking means includes at least one elongated member extending between the top and bottom frame structures, the elongated member being removable from at least one of the top and bottom frame structures to enable the top frame structure to be lowered upon deflation of the bladder assembly.

In one embodiment of the present invention, the elongated member is a stair stepped member including a plurality of segments each having vertical section and a horizontal section, the horizontal sections engagable with at least one of the top and bottom frame structures, whereby the height at which the top frame structure is supported by the stair stepped member is adjusted simply by varying the number of segments disposed between the top and bottom frame structures. A bottom surface of a horizontal section of a bottom most segment of the stair stepped member has a contoured portion for cooperatively engaging a corresponding contoured portion on the bottom frame structure and the top frame structure includes an inclined surface for engagably supporting a horizontal section of one of the segment. A handle is attached to the stair stepped member to enable the stair stepped member to be readily grasped.

In one embodiment of the present invention, the frame assembly further includes a hinge assembly enclosed by the extensible wall structure.

In one embodiment of the present invention, the hinge assembly includes hinges disposed on opposite sides of the frame assembly which are interconnected by transversely extending member.

In one embodiment of the present invention, the hinge assembly includes first and second pairs of hinges disposed proximate opposite sides of the frame assembly, each of the hinges in a pair of hinges having top and bottom elongated members pivotally interconnect to each other at first end and pivotally interconnected to the top and bottom frame structures, respectively at a second end, each of the hinges in the first pair of hinges being connected to a correspond hinge in the second pair of hinges by a transversely extending member which serves as an axis of pivotal motion for the first ends of the elongated members.

In one embodiment of the present invention, the top frame structure is preferably extendible at most five centimeters (roughly one foot) and more preferably two and one-half centimeters (roughly six inches) above the bottom frame structure.

In one embodiment of the present invention, the top and bottom frame structures are made of a relatively rigid support material. In one embodiment the top and bottom frame structures are molded plastic. In yet another embodiment, the top and bottom frame structures are metal.

In one embodiment of the present invention, the vertically extensible wall structure includes plurality of wall segments extending about the periphery of the frame assembly and having interlocking edges.

In one embodiment, a storage structure is provided for storing the leveling apparatus under the camper.

One embodiment of the present invention relates to a leveling system or kit, comprising:

a) a leveling apparatus; comprising:
   - a frame assembly including a top frame structure and a bottom frame structure, the top and bottom frame structures interconnected by a vertically extensible wall structure;
   - an inflatable bladder assembly, the bladder assembly being substantially enclosed by the top and bottom frame structures and the extensible wall structure, whereby the top frame structure is raised and lowered upon inflation and deflation, respectively, of the bladder assembly;
   - locking means for retaining the frame assembly in a raised, extended position upon deflation of the bladder assembly; and
   - fluid inlet/outlet means in fluid communication with the bladder assembly for inflating and deflating the bladder assembly;

b) a level indicator apparatus; and c) fluid source means for supplying fluid under pressure to the inflatable bladder assembly.

In one embodiment, the present invention further relates to a leveling system wherein a relative flat wheel support member is provided for the opposite wheel of the camper, the wheel support member having a top surface which has a recessed contour for assisting in properly positioning the tire of the wheel on the wheel support member.

In one embodiment the fluid source means is an air compressor. In one embodiment the air compressor might have a lighter accessory so it can be plugged into a lighter adaptor of a vehicle for obtaining power from the vehicle's battery. In yet another embodiment, the air compressor might include a twelve volt Nicad battery and a 120 volt AC plug for recharging the battery. In yet other embodiments, the air compressor might be plugged into conventional 120 volt alternating current (AC) outlet.

Yet another embodiment of the present invention relates to a method of leveling a camper, comprising the steps of:

positioning a leveling apparatus in a deflated state, including an inflatable bladder assembly disposed within a frame assembly including a top frame structure and a bottom frame structure interconnected by a vertically extensible wall assembly, at a desired location on the ground;

positioning the camper such that a wheel of the camper on one side of the camper is disposed on the top frame structure of the leveling apparatus;

interconnecting a source of pressurized air to an air inlet of the bladder assembly of the leveling apparatus;

inflating the bladder assembly of the leveling apparatus using the source of pressurized air thereby raising one side of the camper until the camper is substantially level from one side to the other;

locking the frame assembly of the leveling apparatus in the raised, leveled position by positioning at least one support member between the top and bottom frame structures; and at least partially depressurizing the bladder assembly by releasing pressurized air from the bladder assembly through the air inlet.

These and various other features and advantages of novelty which characterize the invention are pointed out with particularity in the claims annexed hereto and forming a part hereof. However, for a better understanding of the invention, its advantages and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

Referring now to the drawings wherein like reference numerals indicate corresponding parts throughout the several views.

DETAILED DESCRIPTION OF A PREFERRED EMBODIMENT

Figure 1:
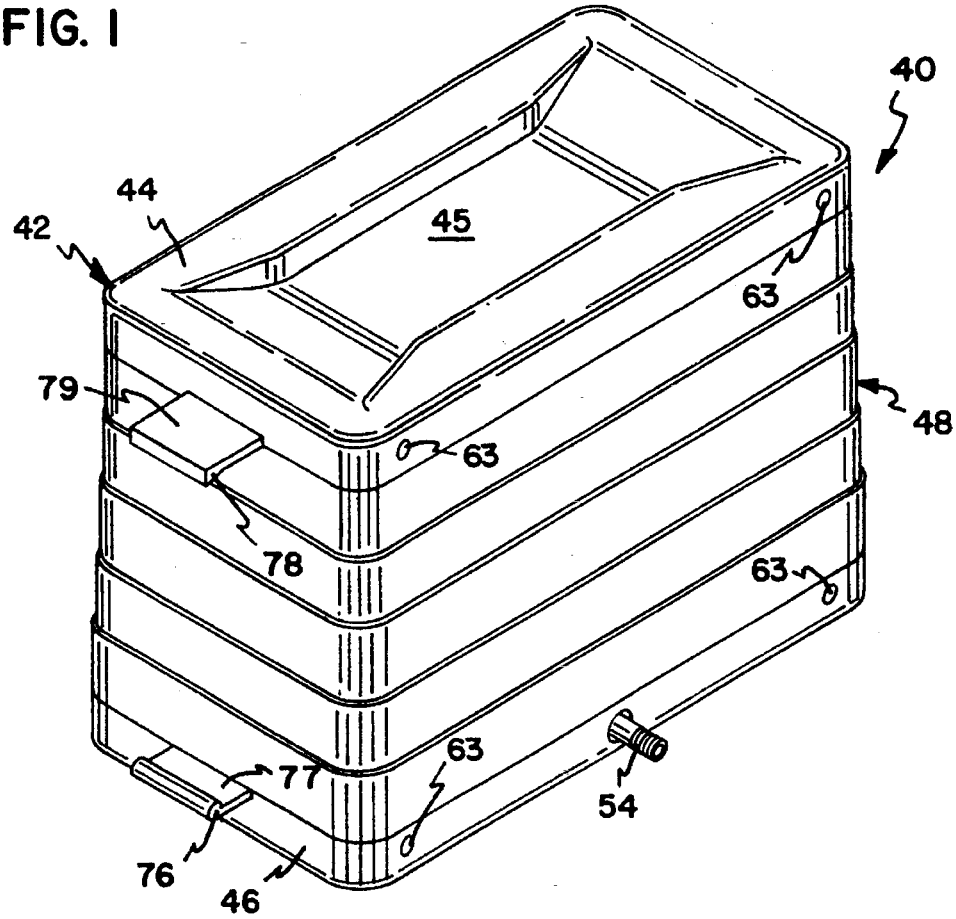
FIG. 1 is a perspective view of an embodiment of a leveling apparatus in accordance with the principles of the present invention in an extended position.

Referring now to the Figures, there is shown an embodiment of a leveling apparatus in accordance with the principles of the present invention, the leveling apparatus being generally referred to by the reference numeral 40. The embodiment of the leveling apparatus shown includes a frame assembly 42 including a top frame structure 44 and a bottom frame structure 46. The top and bottom frame structures 44, 46 are interconnected by a vertically extensible wall structure 48. An inflatable bladder assembly 50 is substantially enclosed by the top and bottom frame structures 44,46 and the extensible wall structure 48, whereby the top frame structure 44 is raised and lowered upon inflation and deflation, respectively, of the bladder assembly 50. A fluid inlet/outlet 54 is in fluid communication with the bladder assembly 50 for inflating and deflating the bladder assembly 50.

It will be appreciated, that in some embodiments, the extensible wall structure 48 might be integral with and formed by the walls of the bladder assembly 50 such that there is not a separate distinct wall. Moreover, in some embodiments, the bladder assembly 50 might not be enclosed by the extensible wall structure 48.

In the embodiment shown, two locking members 52, located on opposite sides of the leveling apparatus 40, are present for retaining the frame assembly 42 in a raised, extended position upon deflation of the bladder assembly 50. In one embodiment, multiple locking members 52 of differing lengths might be used depending on how high the leveling apparatus is raised. The locking members 52 might be completely removable from the leveling apparatus 40 or at least one end might be permanently attached with the leveling apparatus 40 so that the locking members 52 stay with the locking apparatus. It will be appreciated that other locking structures might be used. One example would be telescoping support members which might be locked in the extended position by a detent arrangement. In yet other embodiments of the present invention, the locking members 52 might not be utilized. The leveling apparatus 40 would be retained in a raised position by the inflated bladder assembly 50.

Further, in the embodiment shown, the frame assembly 42 further includes a hinge assembly 56 enclosed by the extensible wall structure 48. It will be appreciated that the hinge assembly 56 might take on varying configurations. In some embodiments of the present invention, the hinge assembly 56 might not be present.

In one embodiment, the top frame structure 44 has a top surface which has a recessed contour 45 to assist in properly positioning a tire on the top frame structure 44. In some embodiments, the bottom frame structure 46 might be roughened or include projections for engaging the ground.

Figure 2:
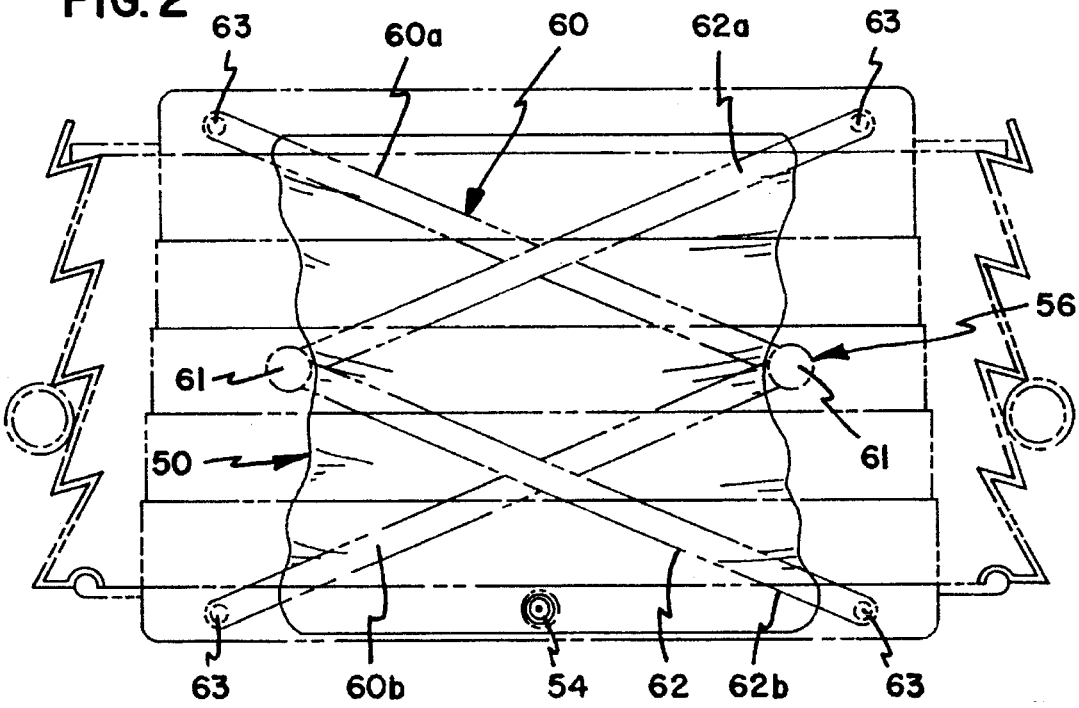
FIG. 2 is a side view of the embodiment shown in FIG. 1 with portions normally not seen being shown in phantom line.
Figure 3:
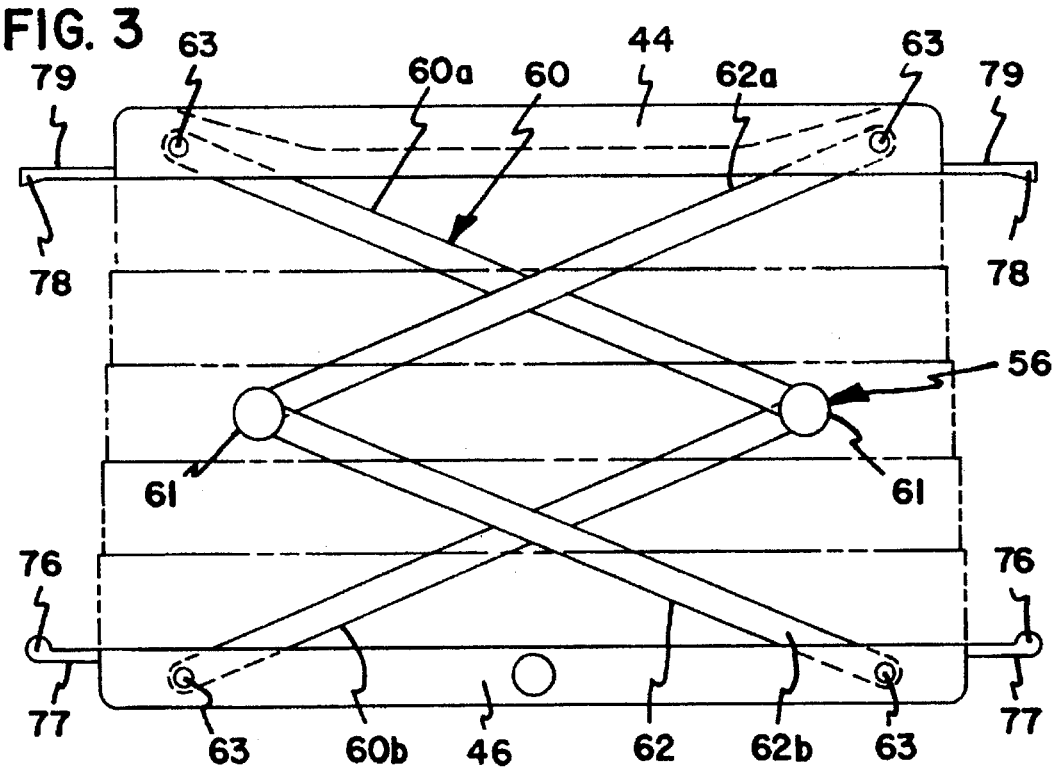
FIG. 3 is a side view illustrating an embodiment of a hinge structure in accordance with the principles of the present invention.
Figure 4:
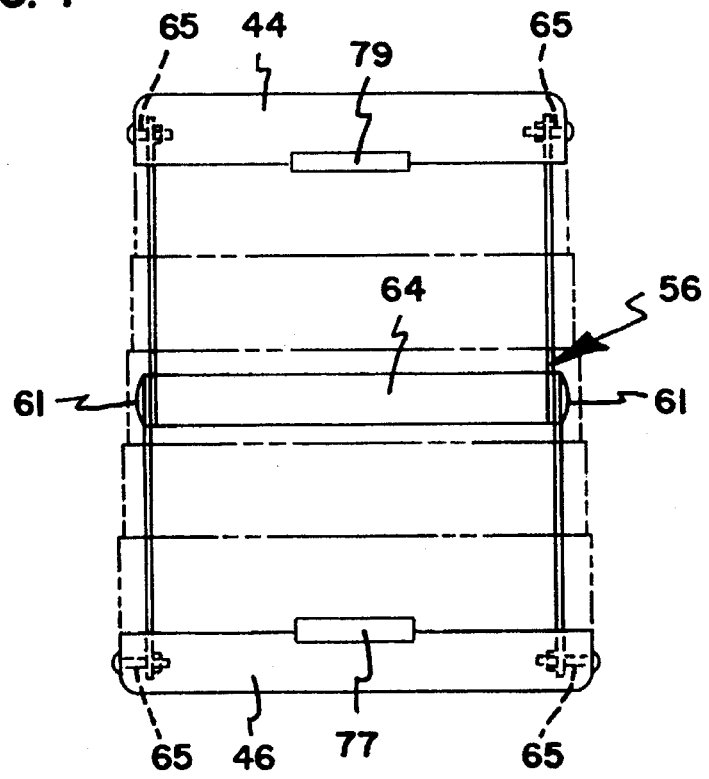
FIG. 4 is an end view illustrating the hinge structure of FIG. 3.

Referring now more particularly to FIGS. 2–4, the hinge assembly 56 of the embodiment of the present invention shown, includes first and second pairs of hinges 60,62 to provide the leveling apparatus 40 with increased stability. Each of the hinges in a pair of hinges having top and bottom elongated members 60*a,b* and 62*a,b*, respectively, which are pivotally interconnect to each other at first end 61 and pivotally interconnected to the top and bottom frame structures, respectively, at a second end 63, each of the hinges in the first pair of hinges being connected to a correspond hinge in the second pair of hinges by a transversely extending member 64 which serves as an axis of pivotal motion for the first ends 61. The second ends 63 might be pivotally attached to members 65 disposed in the top and bottom frame structures 44,46.

Figure 5:
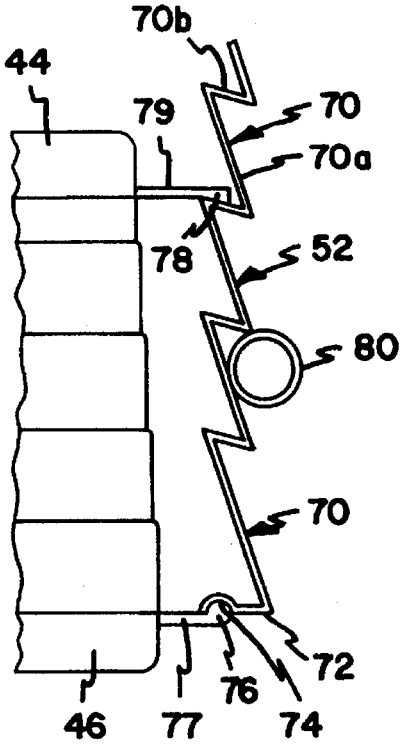
FIG. 5 is a side view of an embodiment of a locking member in accordance with the principles of the present invention illustrating interconnection of the locking member with a frame assembly of the leveling apparatus.

Referring now more particularly to FIG. 5, the locking members 52 are stair stepped and include a plurality of segments 70 each having vertical section 70*a* and a horizontal section 70*b*, the horizontal sections 70*b* are engagable with the bottom frame structure 46, whereby the height at which the top frame structure 44 is supported by the locking members 52 is adjusted simply by varying the number of segments 70 disposed between the top and bottom frame structures 44,46. A bottom surface 72 of a horizontal section of a bottom most segment has a recessed contoured portion 74 for cooperatively engaging a corresponding contoured portion 76 on a projection 77 of the bottom frame structure 44. The top frame structure 46 includes an inclined surface 78 on a projection 79 for engagably supporting a horizontal section of one of the segments 70. A ring 80 is affixed to the locking members so as to serve as a handle whereby the locking members 52 can be readily engaged.

It will be appreciated that the segments 70 have any number of different sizes to allow for an incremental adjustment as desired. In one embodiment the segments 70 might have an incremental vertical sizing of roughly two and ½ centimeters (roughly one inch). In yet another embodiment, the segments 70 might have an incremental vertical sizing of roughly one centimeters (roughly one-half inch).

The total length of the locking members 52 will vary depending on the maximum vertical height extension of the leveling apparatus 40. In one embodiment of the present invention, the top frame structure 44 is preferably extendible at most five centimeters (roughly one foot) and more preferably two and one-half centimeters (roughly six inches) above the bottom frame structure 46.

Figure 6:
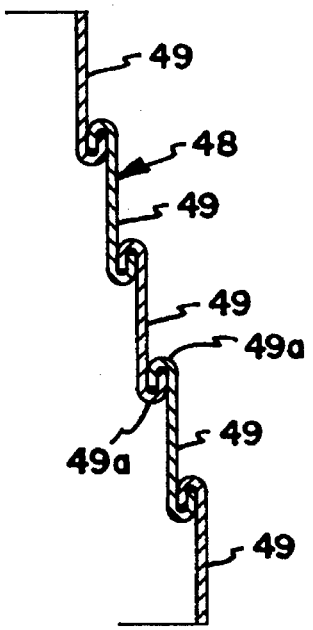
FIG. 6 is a sectional view of an embodiment of an extensible wall in accordance with the principles of the present invention.
Figure 7:
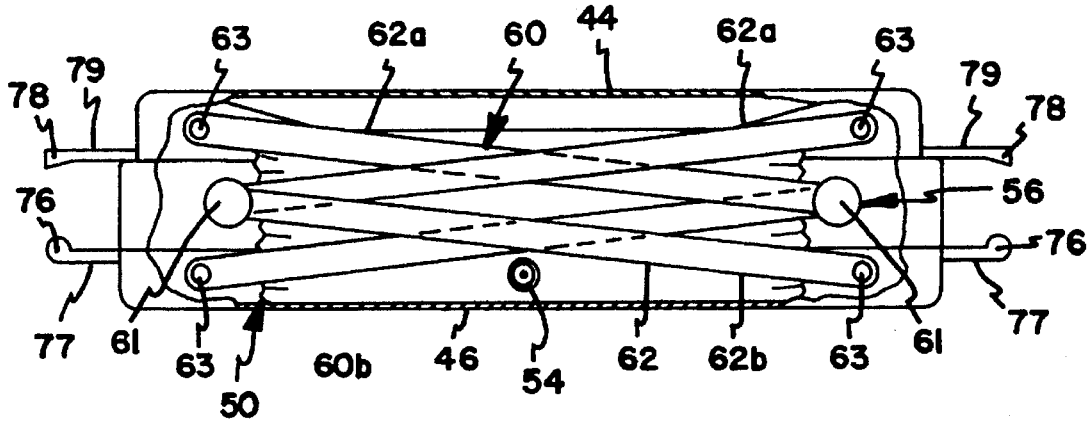
FIG. 7 is a perspective view of an embodiment of a leveling apparatus in accordance with the principles of the present invention in an unextended, deflated position.

Referring more particularly to FIG. 6, the vertically extensible wall structure 48 includes a plurality of wall segments 49 extending entirely about the periphery of the frame assembly and having interlocking edges 49*a*.

In some embodiments, the footprint of the top and bottom frame structures 44,46 might be roughly the size of an 8½" by 11" sheet of paper. However, it will be appreciated that the leveling apparatus 40 might take on varying sizes and configurations.

Figure 8:
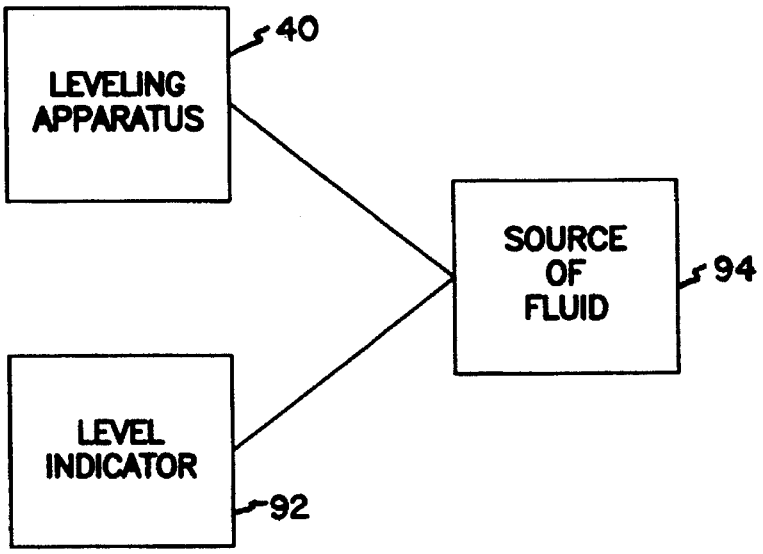
FIG. 8 is a diagrammatic view of a leveling system in accordance with the principles of the present invention.

As shown in FIG. 8, one embodiment of the present invention relates to a leveling system or kit 90. The kit 90 includes the leveling apparatus 40, a level indicator apparatus 92, and a fluid source 94, such as an air compressor, for supplying fluid under pressure to the leveling apparatus. The air compressor 94 might include an adaptor for electrical connection to the cigarette lighter adaptor of a vehicle. The air compressor 94 might also be electrically connected to an outlet on the camper or to electrical power at the camping site. In some applications a manually operated hand pump might be used. In yet other embodiments, a Nicad battery might be provided for powering the air compressor 94 so that the leveling apparatus 40 can be used even in remote locations where there is no power. The level indicator apparatus 92 might be any conventional level indicator. It will be placed on the camper to indicate when the camper is level.

Figure 10:
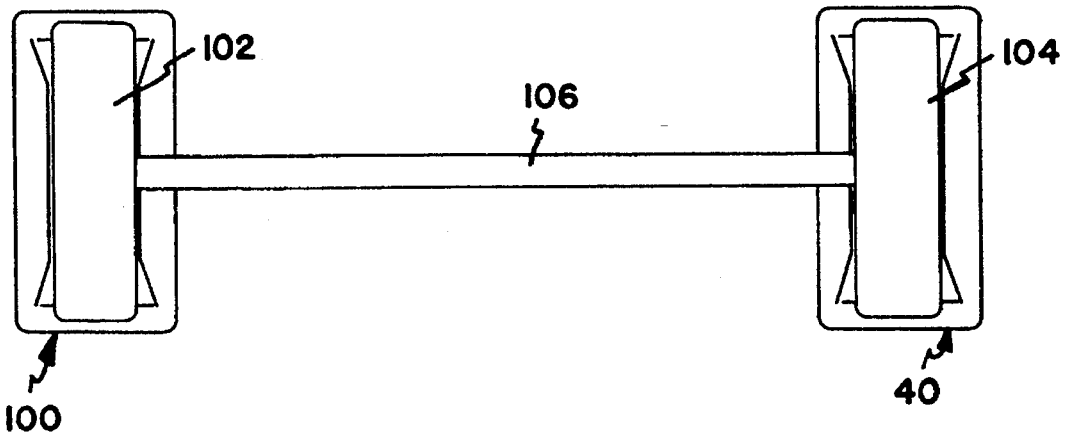
FIG. 10 is a diagrammatic view of a wheel axle assembly wherein one wheel is disposed on the leveling apparatus and an opposite wheel is disposed on a wheel support member.
Figure 9:
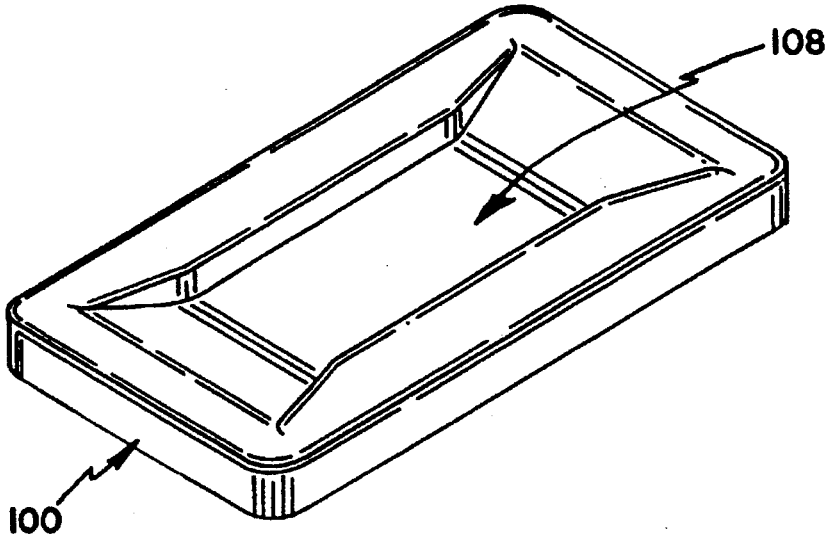
FIG. 9 is an embodiment of a wheel support member.

Referring now to FIG. 9, in one embodiment, the present invention further relates to a leveling system wherein a relative flat wheel support member 100 is provided for a wheel of a camper or other structure which is opposite a wheel supported by the leveling apparatus 40. Referring now to FIG. 10, wheels 102,104 are shown interconnected by an axle 106 of the camper or other structure. The wheel support member 100 has a top surface which has a recessed contour 108, much like the leveling apparatus 40, for assisting in properly positioning the wheel 102 on the wheel support member 100. This insures that both wheels of the camper are properly supported so that the camper wheels will not settle so as to cause the camper to become unleveled. In one embodiment, the wheel support member 100 might be a centimeter or so high.

Figure 11:
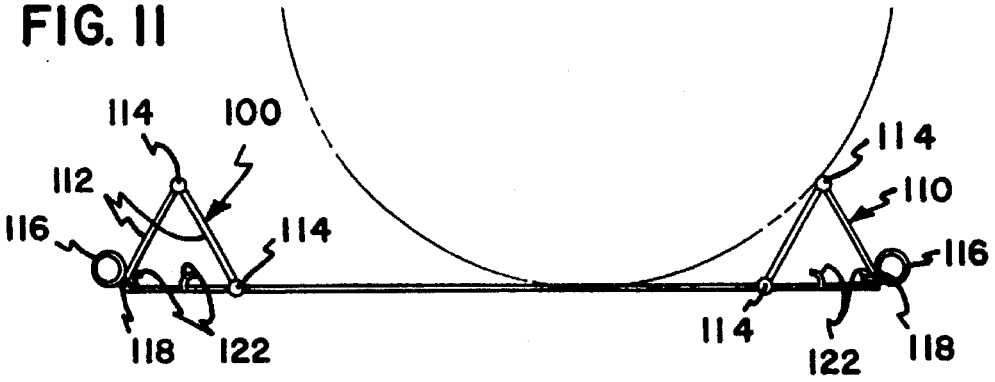
FIG. 11 is an embodiment of al leveling apparatus and/or wheel support member including tire blocking members.

Referring now to FIG. 11, in one embodiment the leveling apparatus 40 and/or the wheel support member 100 might include a wheel blocking assembly 110 for preventing accidental movement of the camper or other structure after being leveled. The blocking assembly 110 might include members 112 interconnected at hinged locations 114. The ring (handle) 116 might be attached to the blocking assembly 110 to facilitate ease of use. A projection 118 defines an aperture 120 for removably engaging a projection 122 so as to retain the blocking assembly 110 in a triangular configuration. It will be appreciated that the blocking assembly might have other configurations and yet be in keeping with the principles of the present invention.

Figure 12:
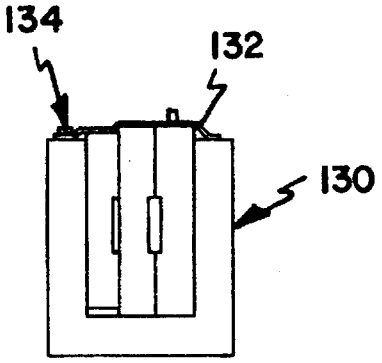
FIG. 12 is a diagrammatic view illustrating an embodiment of a storage structure for storing the leveling apparatus under a floor of the camper.

Referring now to FIG. 12, in one embodiment, a storage structure 130 is provided for storing the leveling apparatus 40 or leveling system of the present invention on a camper or other structure. In the embodiment, the storage structure has a generally U-shape with a flexible, possibly resilient, member 132, such as a strap, being used to removable retain the leveling apparatus 40 and/or support member 100 in a storage space defined by the U-shaped storage structure 130. The flexible member 132 is removable attached at one end to the structure 130 at 134. It will be appreciated that the storage structure 130 might take on any number of different embodiments or configurations.

Figure 13:
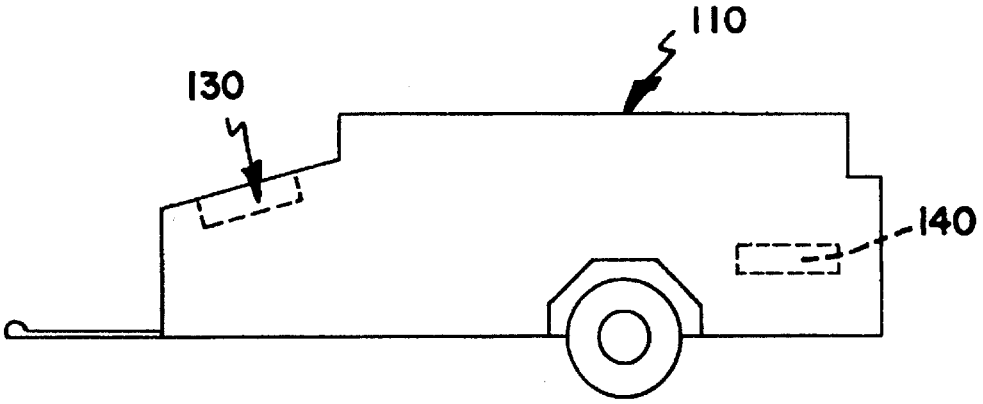
FIGS. 13 is a diagrammatic illustration illustrating various locations where the leveling apparatus might be located on a vehicle or camper.

Illustrated in FIG. 13 is a diagrammatic drawing illustrating possible storage locations for the leveling apparatus 40 on the camper and/or vehicle. The leveling apparatus 40 might be stored in any number of different locations such as under the floor of the camper, in a storage compartment of the camper, adjacent the wheel well of the camper, etc.

Figure 14:
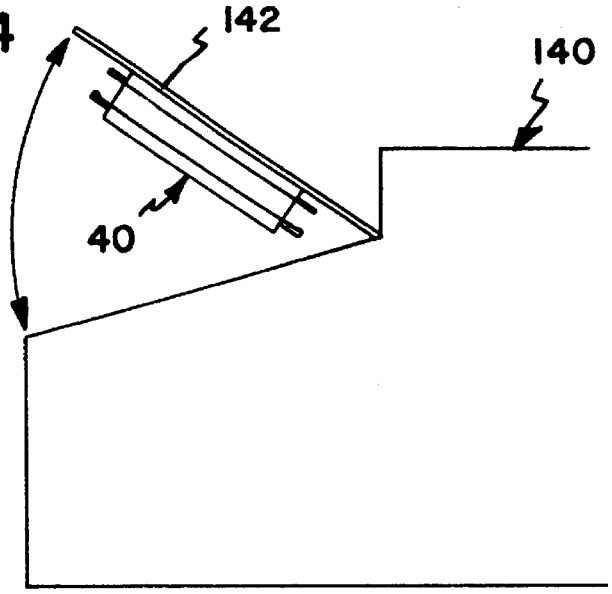
FIG. 14 is a diagrammatic illustration illustrating the leveling apparatus directly attached to a structure.

As shown in FIG. 14, the leveling apparatus 40 might be directly attached to the camper, such on the underside of a hinged cover 142 on a storage compartment of the camper 140. This might be accomplished in any number of ways such as by use of cooperating snap fasteners, velcro fasteners, threaded fasteners, etc.

An embodiment of a method of using the leveling apparatus 40 of the present invention will now be described. The leveling apparatus 40 in a deflated state is disposed at a desired location on the ground. The camper is then positioned such that a wheel of the camper on one side of the camper is disposed on the top frame structure 44 of the leveling apparatus 40. A source of pressurized air 92 is connected to the air inlet 54 of the bladder assembly 50 of the leveling apparatus 44. The bladder assembly 50 of the leveling apparatus 40 is inflated using the source of pressurized air 92 thereby raising one side of the camper until the camper is substantially level from one side to the other. The frame assembly 42 of the leveling apparatus 40 is locked in the raised, leveled position by positioning the locking members 52 between the top and bottom frame structures. At least partially depressurizing the bladder assembly 50 by releasing pressurized air from the bladder assembly 50 through the air inlet 54.

It will be appreciated, that although the present invention is described in terms of use for leveling campers, that the present invention has utility for leveling a wide range of portable structures which are moved from place to place. For example, the leveling apparatus might be used to level portable storage sheds, picnic tables, fishing houses, etc.

The present invention might also be used to support a structure off the surface of the ground in a leveled condition. It will be appreciated that for this purpose, on of the leveling apparatus might be place under each corner or wheel of the structure.

Having read the foregoing description, it is to be understood, that even though numerous characteristics and advantages of various embodiments in accordance with the principles of the invention have been set forth in the foregoing description, together with details of the structure and function of the invention, the disclosure is illustrative only, and changes may be made in detail, especially matters of shape, size and arrangement of the parts within the principles of the invention to the full extent indicated by the broad general meaning of the term in which the appended claims are expressed.

What is claimed is:

1. A leveling apparatus; comprising:

a frame assembly including a top frame structure and a bottom frame structure, the top and bottom frame structures interconnected by a vertically extensible wall structure;

an inflatable bladder assembly, the bladder assembly being substantially enclosed by the top and bottom frame structures and the extensible wall structure, whereby the top frame structure is raised and lowered upon inflation and deflation, respectively, of the bladder assembly;

locking means for retaining the frame assembly in a raised, extended position upon deflation of the bladder assembly; and fluid inlet and outlet means in fluid communication with the bladder assembly for inflating and deflating the bladder assembly.

2. An apparatus in accordance with claim 1, wherein the top frame structure has a top surface which has a recessed contour to assist in properly positioning a tire on the top frame structure.

3. An apparatus in accordance with claim 1, wherein the locking means includes at least one elongated member extending between the top and bottom frame structures, the elongated member being removable from at least one of the top and bottom frame structures to enable the top frame structure to be lowered upon deflation of the bladder assembly.

4. An apparatus in accordance with claim 3, wherein the elongated member is a stair stepped member including a plurality of segments each having a vertical section and a horizontal section, the horizontal sections engagable with at least one of the top and bottom frame structures, whereby the height at which the top frame structure is supported by the stair stepped member is adjusted simply by varying the number of segments disposed between the top and bottom frame structures.

5. An apparatus in accordance with claim 4, wherein a bottom surface of a horizontal section of a bottom most segment of the stair stepped member has a contoured portion for cooperatively engaging a corresponding contoured portion on the bottom frame structure and the top frame structure includes an inclined surface for engagably supporting a horizontal section of one of the segments.

6. An apparatus in accordance with claim 5, wherein a handle is attached to the stair stepped member.

7. An apparatus in accordance with claim 1, the frame assembly further including a hinge assembly enclosed by the extensible wall structure.

8. An apparatus in accordance with claim 7, wherein the hinge assembly includes hinges disposed on opposite sides of the frame assembly which are interconnected by a transversely extending member.

9. An apparatus in accordance with claim 7, wherein the hinge assembly includes first and second pairs of hinges disposed proximate opposite sides of the frame assembly, each of the hinges in a pair of hinges having top and bottom elongated members pivotally interconnected to each other at first end and pivotally interconnected to the top and bottom frame structures, respectively at a second end, each of the hinges in the first pair of hinges being connected to a corresponding hinge in the second pair of hinges by a transversely extending member which serves as an axis of pivotal motion for the first ends of the elongated members.

10. An apparatus in accordance with claim 1, wherein the top frame structure is extendible at most five centimeters above the bottom frame structure.

11. An apparatus in accordance with claim 1, wherein the top and bottom frame structures are molded plastic.

12. An apparatus in accordance with claim 1, wherein the top and bottom frame structures are metal.

13. An apparatus in accordance with claim 1, wherein the vertically extensible wall structure includes a plurality of wall segments extending about the periphery of the frame assembly and having interlocking edges.

14. A leveling kit, comprising:

a leveling apparatus; comprising:

a frame assembly including a top frame structure and a bottom frame structure, the top and bottom frame structures interconnected by a vertically extensible wall structure;

an inflatable bladder assembly, the bladder assembly being substantially enclosed by the top and bottom frame structures and the extensible wall structure, whereby the top frame structure is raised and lowered upon inflation and deflation, respectively, of the bladder assembly;

locking means for retaining the frame assembly in a raised, extended position upon deflation of the bladder assembly; and fluid inlet and outlet means in fluid communication with the bladder assembly for inflating and deflating the bladder assembly;

a level indicator apparatus; and fluid source means for supplying fluid under pressure to the inflatable bladder assembly.

15. A kit in accordance with claim 14, further including a relatively flat wheel support member which is configured to support an opposite wheel of the camper, the wheel support member having a top surface which has a recessed contour for assisting in properly positioning the tire of the wheel on the wheel support member, whereby the wheel support member and the leveling apparatus are positionable under opposite wheels of a camper to be leveled.

16. A kit in accordance with claim 14, further including a storage structure for storing the leveling apparatus.

17. A kit in accordance with claim 14, wherein the fluid source means is an air compressor, the kit further including a battery for powering the air compressor.

18. A method of leveling a camper, comprising the steps of:

positioning a leveling apparatus in a deflated state, including an inflatable bladder assembly disposed within a frame assembly including a top frame structure and a bottom frame structure interconnected by a vertically extensible wall assembly, at a desired location on the ground;

positioning the camper such that a wheel of the camper on one side of the camper is disposed on the top frame structure of the leveling apparatus;

interconnecting a source of pressurized air to an air inlet of the bladder assembly of the leveling apparatus;

inflating the bladder assembly of the leveling apparatus using the source of pressurized air thereby raising one side of the camper until the camper is substantially level from one side to the other;

locking the frame assembly of the leveling apparatus in the raised, leveled position by positioning at least one support member between the top and bottom frame structures for retaining the leveling apparatus in the raised, leveled position; and at least partially depressurizing the bladder assembly by releasing pressurized air from the bladder assembly through the air inlet.

19. A method in accordance with claim 18, further including the step of positioning an opposite wheel of the camper on a wheel support member.

* * * * *